US011590041B2

(12) United States Patent
Salzer

(10) Patent No.: US 11,590,041 B2
(45) Date of Patent: Feb. 28, 2023

(54) METHOD AND APPARATUS FOR MAINTAINING A PATIENT IN A PRONE POSITION TO IMPROVE RESPIRATION

(71) Applicant: Jennifer E. Salzer, New York, NY (US)

(72) Inventor: Jennifer E. Salzer, New York, NY (US)

( * ) Notice: Subject to any disclaimer, the term of this patent is extended or adjusted under 35 U.S.C. 154(b) by 0 days.

(21) Appl. No.: 17/325,800

(22) Filed: May 20, 2021

(65) Prior Publication Data

US 2021/0361511 A1 Nov. 25, 2021

Related U.S. Application Data

(60) Provisional application No. 63/027,513, filed on May 20, 2020.

(51) Int. Cl.
*A61G 13/12* (2006.01)

(52) U.S. Cl.
CPC ..... *A61G 13/1215* (2013.01); *A61G 13/122* (2013.01)

(58) Field of Classification Search
CPC .. A61G 13/12; A61G 13/1215; A61G 13/122; A61G 7/07; A61G 2200/325; A47C 20/00; A47C 20/02; A47C 20/025; A47C 20/026; A47G 9/10; A47G 2009/1018; A47G 9/1054
See application file for complete search history.

(56) References Cited

U.S. PATENT DOCUMENTS 6,795,990 B1 * 9/2004 Hutchinson ..... A47C 20/027 5/652

* cited by examiner

*Primary Examiner* — Fredrick C Conley
(74) *Attorney, Agent, or Firm* — Marcus C. Dawes

(57) ABSTRACT

An apparatus and method for maintaining a patient in the prone position while maintaining access to the patient's oral airway. The apparatus includes a body portion which in turn has a plurality of segments, each of which may accommodate a number of inserts therein as determined by the relative size of the patient. The segments may be selectively joined together approximately midway along the body portion and the inserts disposed therein may be independently adjusted so as to raise the patient's chest and hips off of a surface. The distal ends of the same segments may also be joined together to further form a head rest which maintains the patient's head and face off of the surface, thereby permitting access to the patient's oral airway even when the patient is lying face down. The inserts are removable and may be stored separately from the body portion when not in use.

20 Claims, 8 Drawing Sheets

METHOD AND APPARATUS FOR MAINTAINING A PATIENT IN A PRONE POSITION TO IMPROVE RESPIRATION

This application claims priority to, and the benefit of the earlier filing date of U.S. provisional patent application entitled "Method and Apparatus for Accommodating a Patient in a Prone Position to Improve Respiration," filed on May 20, 2020, Ser. No. 63/027,513, pursuant to 35 USC 119, the contents of all of which are incorporated herein by reference.

BACKGROUND

Field of the Technology

The invention relates to the field of patient care, specifically an apparatus and method for accommodating a patient or user to lay in a prone position, thereby improving their respiratory function and assisting in the recovery of a respiratory illness or condition.

Description of the Prior Art

When a patient who is suffering from acute respiratory distress caused by any number of factors including pneumonia, influenza, coronavirus, asthma, COPD or a physical trauma is brought in for medical treatment, the patient is most often laid down in the supine position while the treatment is being administered. Specifically, the patient is laid on their back in order to be treated or intubated so that their breathing may assisted or controlled by a mechanical ventilator. However, because gravity often directs fluid being collected within the patient's lungs back towards the dorsal region of the patient, the patient can often have great difficulty in breathing even with the assistance of a mechanical ventilator.

As has long been known in the medical field, patients suffering from acute respiratory distress who fail to improve after being placed on a ventilator are often rotated into the prone position. The reversal from lying on their back to lying on their stomach reverses the flow of fluid through their lungs which in turn relieves pressure and improves the patient's ability to breathe, even without a ventilator. In some instances, the patient may begin to feel relief in as little as a few minutes after being moved into the prone position.

While laying a patient down in the prone position is not typically a problem when done in a hospital or other medical care facility, a problem develops however when these facilities become overwhelmed and do not have enough beds or ventilators to meet the current patient demand. Additionally, for patients who remain conscious, it can be difficult or uncomfortable for them to lie in the prone position for extended periods of time on a substantially flat surface such a bed or gurney, particularly if they are elderly or otherwise physically compromised such as being overweight or having a larger than average chest. Finally, while laying prone in general enhances the patient's ability to breathe, this ability can be further improved by keeping the patient's chest and abdomen slightly off of the surface they are currently laying on, thereby further reducing the pressure placed on their already compromised respiratory system.

One possible solution to these issues has been to place pillows under the patient, however standard pillows are ill suited to support a patient in a prone position without requiring the patient to also turn their neck to either side, thereby altering the orientation of their oral airway. Additionally, in order for the patient's hips and shoulders to be supported and thus raise the patient's chest and abdomen slightly off the bed, several pillows would be required and would thus require more resources from the hospital or medical care facility, let alone full body support, and taking up too much room in an already small bed, cot, or gurney.

Other solutions have been to place other objects such as towels or other soft malleable items underneath the patient, thereby propping up the patient at the positions where those items are placed. However many of these objects lack sufficient rigidly and can often deform after prolonged use, thereby requiring frequent adjustment and repositioning by a health care worker.

What is needed is a physical support which is easy and simple to use which accommodates a patient in the prone position and which lifts or maintains the chest and abdominal regions of the patient off the surface they are laying on. The support should also sufficiently rigid so that it does not lose its shape over time. Additionally, the support should be compatible with pre-existing items that the health care provider may already possess, thereby reducing the overall cost of the support and allowing those pre-existing items to be used for other purposes when the support is not in use. Ideally, this support or pillow would just become laundry when disassembled, requiring no extra or specialized storage of the device.

BRIEF SUMMARY

An apparatus for maintaining a patient in a prone position while maintaining access to an oral airway of the patient. The apparatus includes a body portion, a first plurality of inserts, and a second plurality of inserts. In one embodiment, the first plurality of inserts has a smaller size relative to the second plurality of inserts. The apparatus also includes a means for forming a partition along a length of the body portion. Each of the first plurality of inserts and the second plurality of inserts can be moved independently of one another within the body portion to a position determined by the user.

In one embodiment, the body portion is defined by at least two segments, wherein each of the segments can accommodate at least one of the first plurality of inserts and at least one of the second plurality of inserts therein. In this embodiment the means for forming the partition along a length of the body portion also includes a means for dividing each of the at least two segments into an upper portion and a lower portion. At least one of the first plurality of inserts is disposed within the lower portion of each segment while at least one of the second plurality of inserts is in turn disposed within the upper portion of each segment.

In a separate embodiment, the upper portion of each segment is configured to be independently adjustable relative to each other, while the lower portion of each segment is configured to be independently adjustable relative to each other.

In another embodiment, the body portion of the apparatus has an opening communicated to the two segments of the body portion.

In yet another embodiment, each of the at least two segments include a coupling means that is disposed along at least a portion of their respective longitudinal lengths.

In another embodiment, the means for forming a partition along a length of the body portion includes at least one tapered width portion that is disposed along the respective lengths for each segment of the body portion.

In a related embodiment, the means for forming a partition along a length of the body portion includes a means for coupling the at least two segments of the body portion together.

In yet another related embodiment, the means for forming a partition along a length of the body portion includes a knot that joins the two segments to each other.

In a further embodiment, each of the segments of the body portion have a distal end, each distal end including a means for coupling the at least two segments together.

In yet another embodiment, that apparatus further provides a user the ability to adjust the relative position of the partition along the length of the body portion.

The invention further provides a method for maintaining a patient in a prone position while maintaining access to an oral airway of the patient. The method includes providing a body portion, inserting a first plurality of inserts into the body portion, and then forming a partition along a length of the body portion. Next, a second plurality of inserts is inserted into the body portion, wherein the first plurality of inserts has a smaller size relative to the second plurality of inserts. Finally, a position associated with each of the first plurality of inserts is manipulated or adjusted relative to each the second plurality of inserts within the body portion.

In one embodiment, inserting the first plurality of inserts into the body portion specifically includes inserting at least one of the first plurality of inserts into each of at least two segments defining the body portion, while inserting the second plurality of inserts into the body portion specifically includes inserting at least one of the second plurality of inserts into each of the at least two segments.

In a related embodiment, forming the partition along a length of the body portion further includes dividing each of the at least two segments into an upper portion and a lower portion.

In another embodiment, adjusting the position associated with each of the first plurality of inserts relative to the second plurality of inserts within the body portion also includes adjusting a relative position associated with the upper portion of each of the two segments in order to support the chest and hips of the patient. Alternatively, adjusting a relative position associated with the lower portion of each of the two segments in order to support the head and neck of the patient.

In one embodiment, inserting the first plurality of inserts into the body portion specifically includes disposing at least one of the first plurality of inserts into an upper portion of the body and then sealing the upper portion around the at least one of the first plurality inserts. Next, one of the second plurality of inserts is inserted into the body portion by disposing at least one of the second plurality of inserts into a lower portion of the body and then sealing the lower portion around the at least one of the second plurality of inserts. More specifically, the sealing of the upper portion around one of the first plurality of inserts is done by coupling a pair of lateral edges of the upper portion to each other with one of the first plurality of inserts disposed therein. Similarly, the sealing of the lower portion around one of the second plurality of inserts is done by coupling a pair of lateral edges of the lower portion to each other with one of the second plurality of inserts disposed therein.

In another embodiment, the partition is formed along a length of the body portion further by coupling the at least two segments defining the body portion to each other.

In an additional embodiment, the method also includes coupling a distal end of each of the at least two segments defining the body portion to each other.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
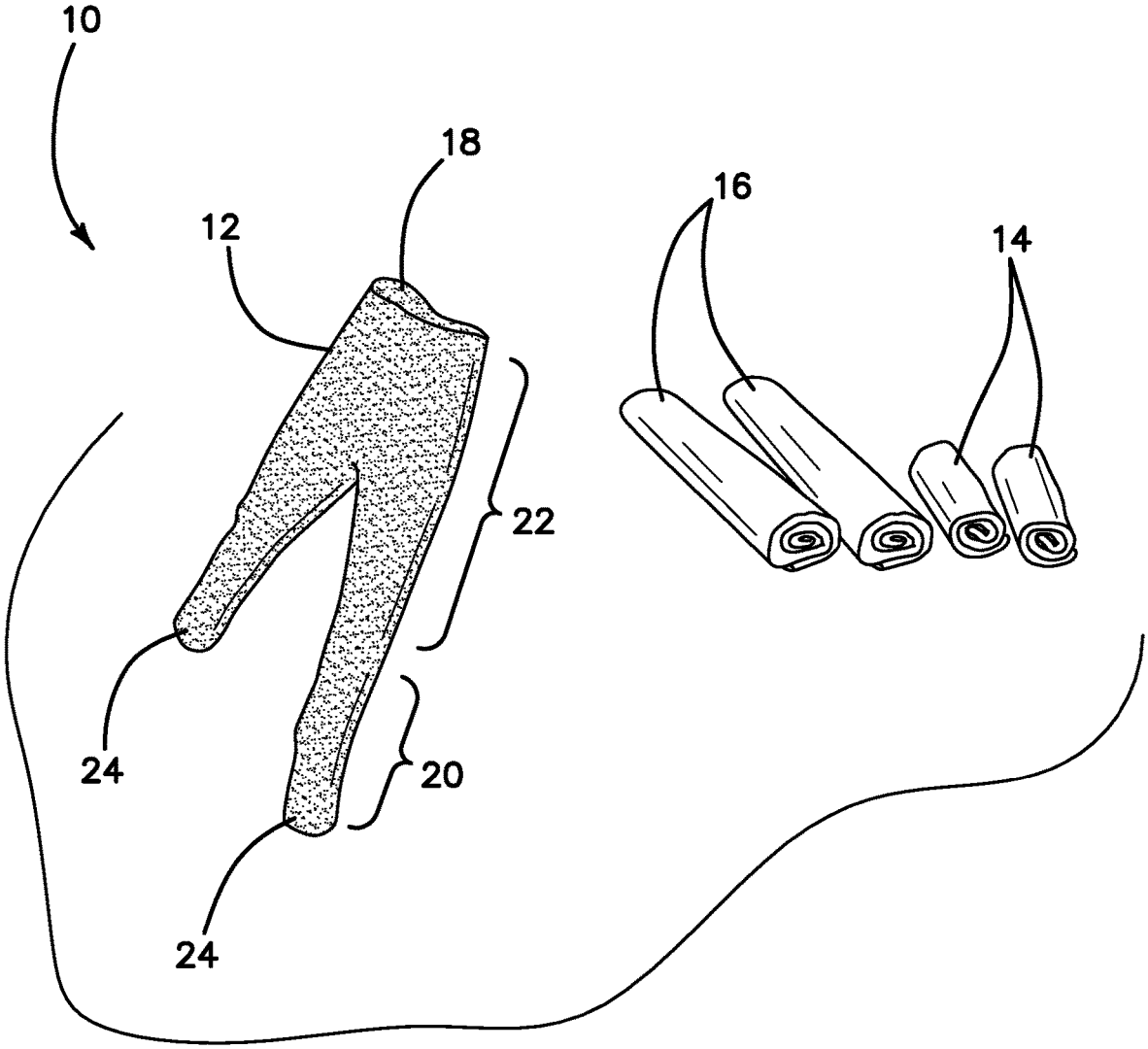
FIG. 1 is a partially exploded view of the apparatus of the current invention which comprises a body portion and plurality of inserts of at least two different sizes.

Greater detail of the current invention may be seen in greater detail in FIG. 1 where it is denoted in general by reference numeral 10. The support 10 comprises a body portion 12 which is preferably comprised of soft, elastic washable material such as cotton, polyester, nylon, or other similar materials or blends of materials now known or later devised. The body portion 12 comprises a pair of cylindrical or tube-like segments 24 which are joined or coupled together at their respective proximal ends. Each segment 24 comprises a lower portion 20 forming their respective distal ends and an upper portion 22 forming their respective proximal ends, each upper portion 22 sharing a common opening 18.

The support 10 also comprises a plurality of inserts, specifically a plurality of small inserts 14 and a plurality of large inserts 16. Both the small inserts 14 and the large inserts 16 comprise a substantially cylindrical cross section, however each of the small inserts 14 comprise a smaller diameter relative to the large inserts 16. Each of the plurality of inserts 14, 16 are comprised of soft yet durable material such as cotton, foam, polyester fabric, or other similar materials or blends of materials now known or later devised. Additionally, each insert 14, 16 is preferably formed by rolling a segment of material or fabric similar to what is used in common bath towels into a substantially cylindrical or rolled shape, however in other alternative embodiments each insert may be comprised of a single pre-formed shape such as a sphere or ball, a rectangular prism or brick shape, a cube or square box, or any other suitable geometric shape. In one embodiment, the plurality of inserts 14, 16 may be exclusive to only being used in conjunction with the body portion 12 of the support 10, however in a preferred embodiment, the inserts 14, 16 are each comprised of a rolled absorbent material or fabric. Specifically, the inserts 14, 16 may be used as a separate cleaning or bathing item such as a towel, washcloth, or a cleaning shammy or wipe. The plurality of inserts 14, 16 are washable and reusable, thereby allowing the user to use at least a portion of the support 10 for other purposes when not otherwise being specifically used to support a patient while lying the prone position.

Figure 2:
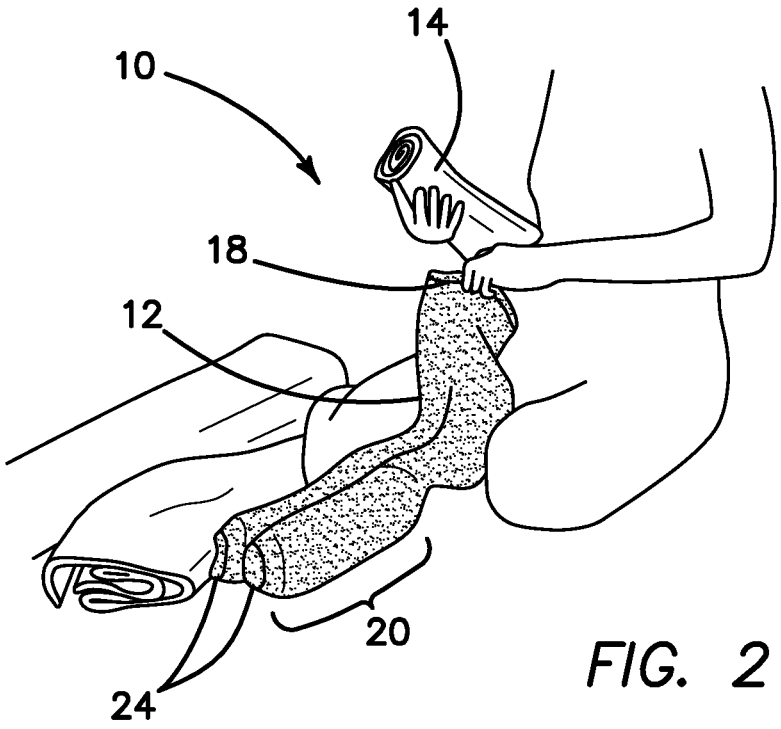
FIG. 2 is a perspective view of a user after the user has inserted an insert into one of two segments defining the body portion seen in FIG. 1.
Figure 3:
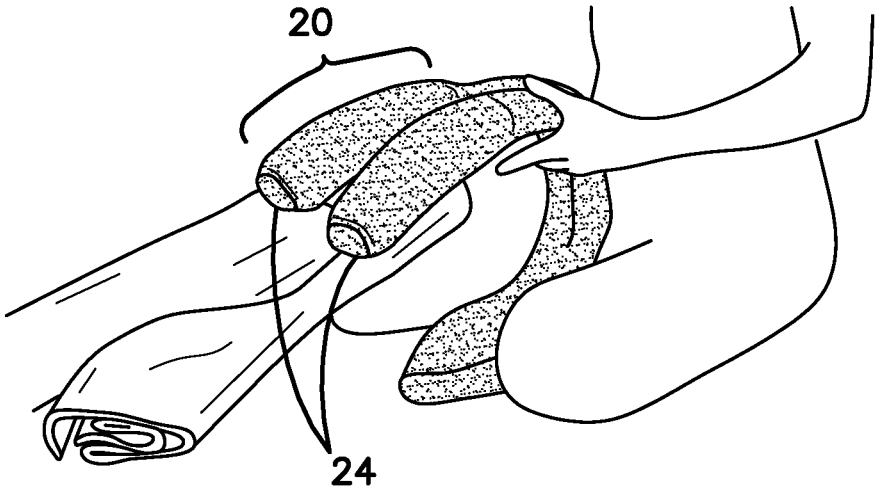
FIG. 3 is a perspective view of the user seen in FIG. 2 after the user has inserted an insert into the second of two segments defining the body portion.

To use the support 10, a user begins by gripping the proximal portion of the body 12 and pulling it apart, thereby actuating the opening 18 as seen in FIG. 2. Next, the user inserts one of the plurality of small inserts 14 into the one of the two segments 24 by inserting the small insert 14 through the opening 18 and then pushing the small insert 14 through the upper portion 22 and into the lower portion 20 of the selected segment 24. The small insert 14 is continually pushed to the very distal end of the segment 24 until it is no longer possible to move the small insert 14 through the lower portion 20. The process is then repeated using another one of the plurality of small inserts 14 for the remaining segment 24 so that the distal end of each lower portion 20 comprises at least one small insert 14 inserted therein as seen in FIG. 3.

Figure 4:
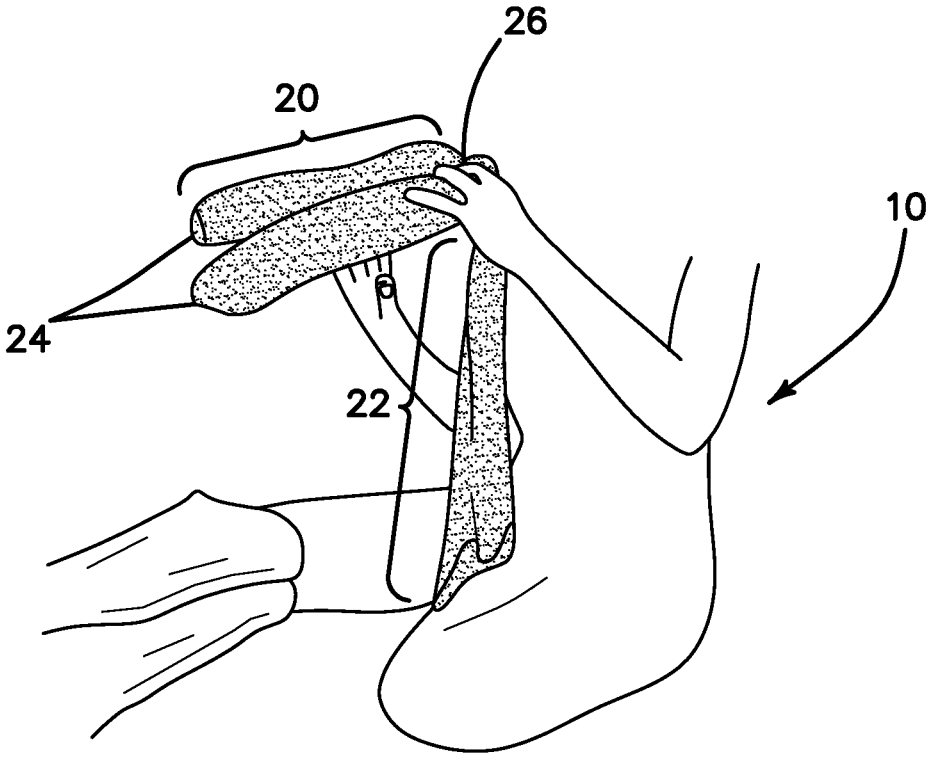
FIG. 4 is a perspective view of the user seen in FIG. 3 after the user has formed a partition once an insert has been inserted into each of the two segments defining the body portion, the partition dividing each of the two segments into a lower portion and an upper portion.
Figure 5:
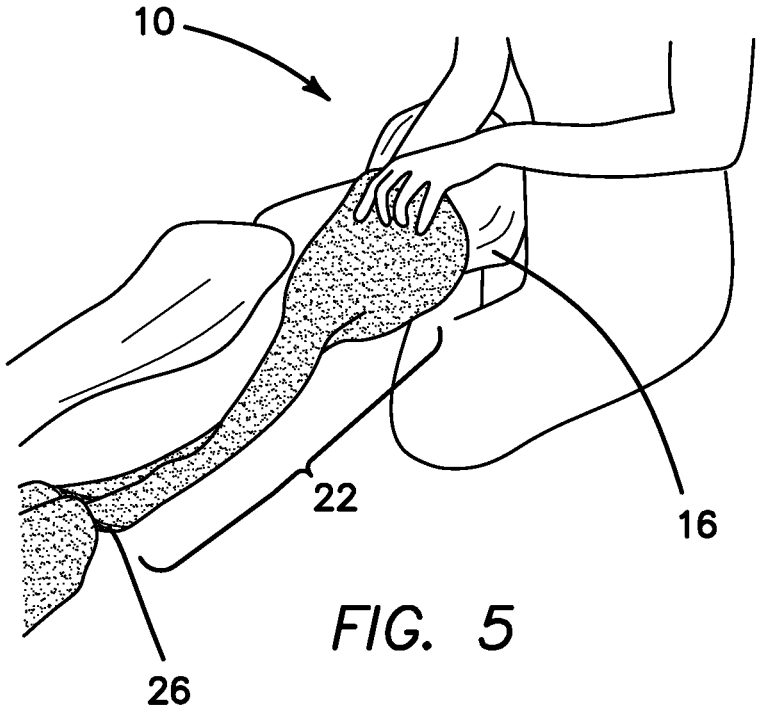
FIG. 5 is a perspective view of the user seen in FIG. 4 as the user inserts an insert into the upper portion of one of the two segments defining the body portion.
Figure 6:
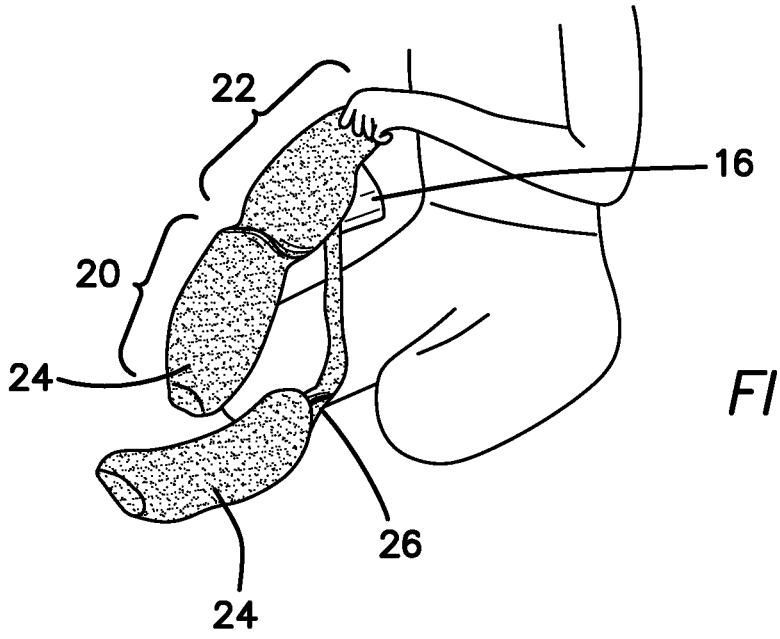
FIG. 6 is a perspective view of the user seen in FIG. 5 after the user has fully inserted the insert into the upper portion of one of the two segments defining the body portion.

Turning to FIG. 4, after filling the distal ends of each lower portion 20 of each segment 24, the user twists or rotates each segment 24 directly behind where the small insert 14 is disposed to create a knot or other partition 26 dividing the lower portion 20 from the upper portion 22 of each segment 24. The user may simply leave the partition 26 as is, or alternatively may reinforce the partition 26 by applying a rubber band, clamp, or other mechanical means which prevent the partition 26 from coming undone. Next, the user inserts at least one of the plurality of large inserts 16 into the upper portion 22 of each segment 24 as seen in FIG. 5. The user continues to push or move each large insert 16 through the upper portion 22 until it makes contact or is near the partition 26 as demonstrated in FIG. 6.

Figure 7:
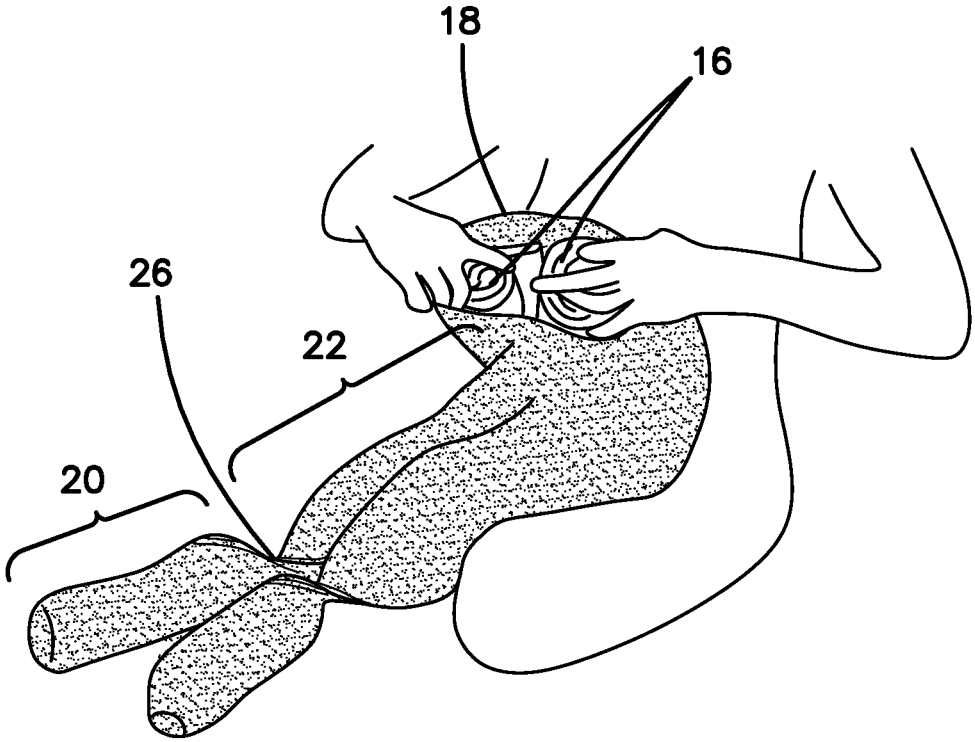
FIG. 7 is a perspective view of the user seen in FIG. 6 after inserts have been inserted into the upper portion of both segments defining the body portion.
Figure 8:
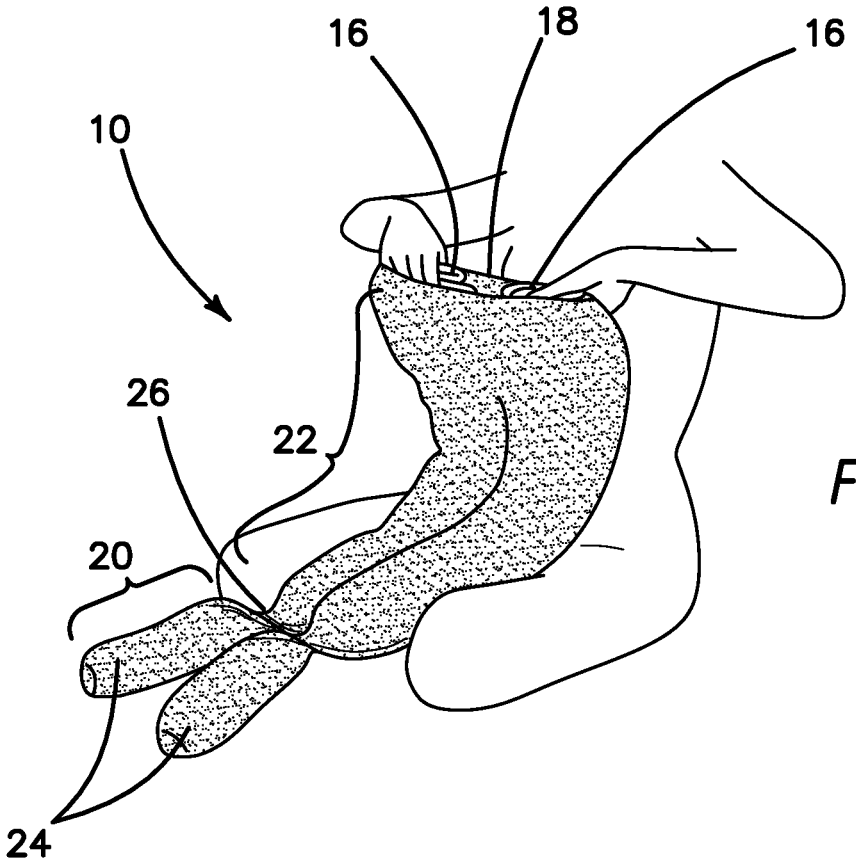
FIG. 8 is a perspective view of the user seen in FIG. 7 as they adjust the body portion by separating the inserts disposed within the upper portion of each segment.

Turning to FIG. 7 it can be seen that after each of the plurality of large inserts 16 have been inserted into each respective upper portion 22, the large inserts 16 are adjacently disposed next to each other near or at the opening 18. The large inserts 16 remain independent of each other, thereby allowing the user to further manipulate the positioning of either large insert 16 within each respective upper portion 22 or to even pull the large inserts 16 away from each other in the lateral direction as seen in FIG. 8.

While the figures discussed above explicitly show four inserts being inserted into the body 12 of the support 10, specifically two small inserts 14 and two large inserts 16, this is meant to be for illustrative purposes only. Fewer or additional small or large inserts 14, 16, or inserts of a different size not explicitly shown, may also be used without departing from the original spirit and scope of the invention. Additionally, while it is disclosed that the small inserts 14 are first inserted into each segment 24 followed by a large insert 16, it is also expressly contemplated that additional or different sequences of inserts may be used in order to provide a support 10 for each unique patient.

Figure 9:
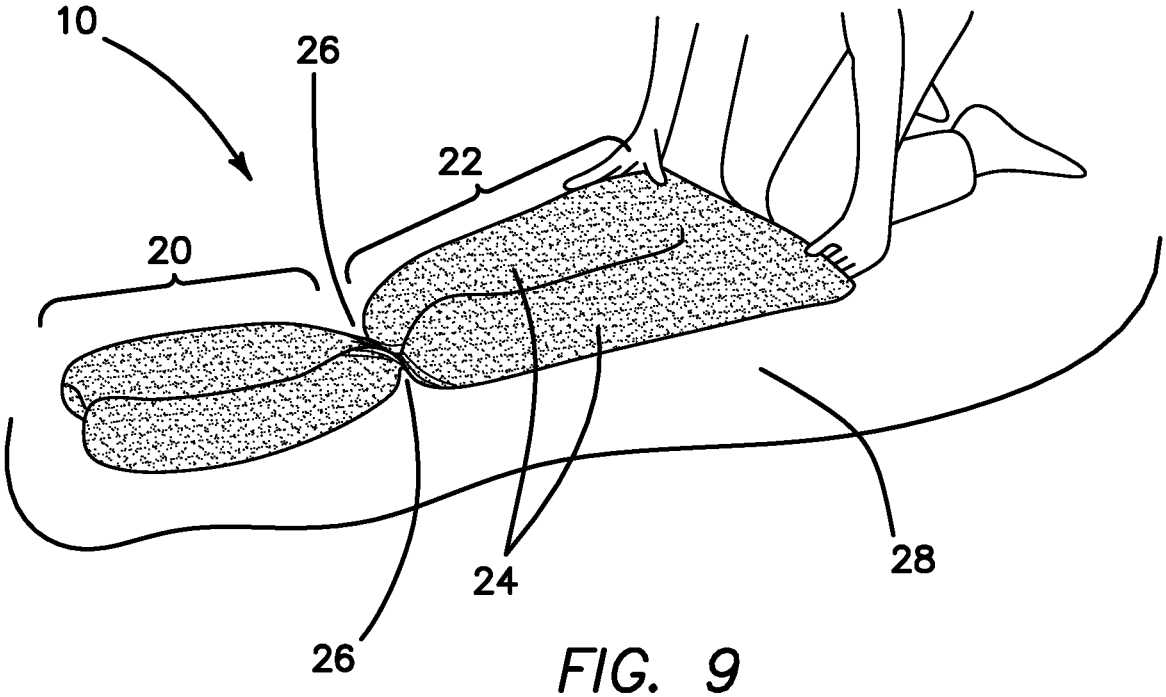
FIG. 9 is a perspective view of the apparatus after being placed on a flat surface, the upper portion of each segment being located more proximal to the user relative to the lower portion of each segment.
Figure 10:
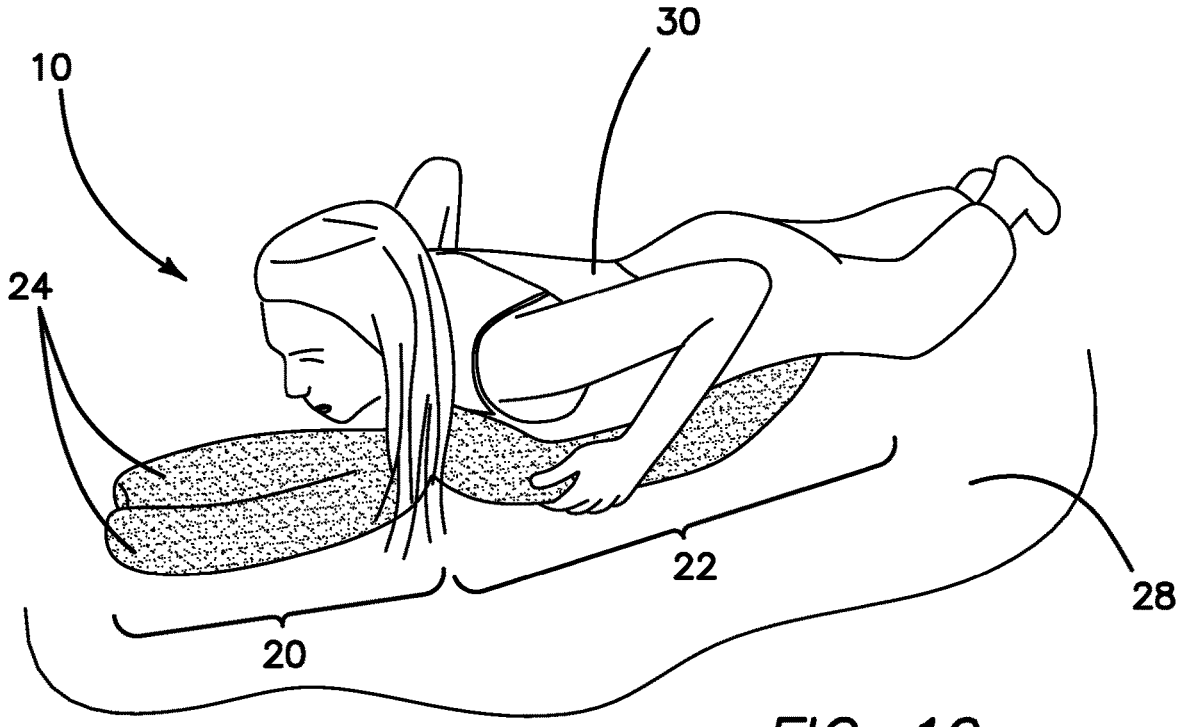
FIG. 10 is a perspective view of the apparatus seen in FIG. 9 after the user has disposed the lower half of their body on the upper portions of each segment, specifically with their chest and hips maintained in an elevated position by the upper portions of each segment.

Once the plurality of inserts 14, 16 have been properly positioned or adjusted within either the lower portions 20 or upper portions 22 of each respective segment 24, the user as seen in FIG. 9 places the formed support 10 on a flat surface 28 with segments 24 adjacently disposed to one another. The flat surface 28 may be the top surface of a bed or gurney, however any flat surface such as a table or floor may be used, thereby allowing the user to rest a patient in the prone position in nearly any location such as their home or other dwelling. A patient 30 is then laid or placed on the body portion 12 of the support 10 with their thighs and hips placed upon the proximal end of each upper portion 22 of each segment 24 adjacent to the opening 18. With the hips of the patient 30 weighing down the proximal end of the body 12 as seen in FIG. 10, each distal end of each upper portion 22 is further adjusted by pulling each upper portion 22 away from each other and towards the outside of the patient's body, thereby leaving the patient's chest and abdomen free to expand within the volume created there between. Additionally, if the large inserts 16 are laterally pulled away from each other to either side of the patient's 30 hips, the fabric comprising the upper portion 22 forms a resilient sub-support which spans across the entire width of the patient's 30 hips, thereby providing the support 10 with the ability to hold the patient's 30 hips completely off of the flat surface 28. In other words, the surface area of the upper portions 22 stretch across between where the large inserts 16 are located and hold up the hips of the patient 30. By spreading apart of the large inserts 16, a netting or support is formed in between which in turn makes the support 10 suspend and maintain the patient 30 above the flat surface 28. Additionally, disposing the large inserts 16 further anchors the proximal ends of each of the segments 24.

Figure 11:
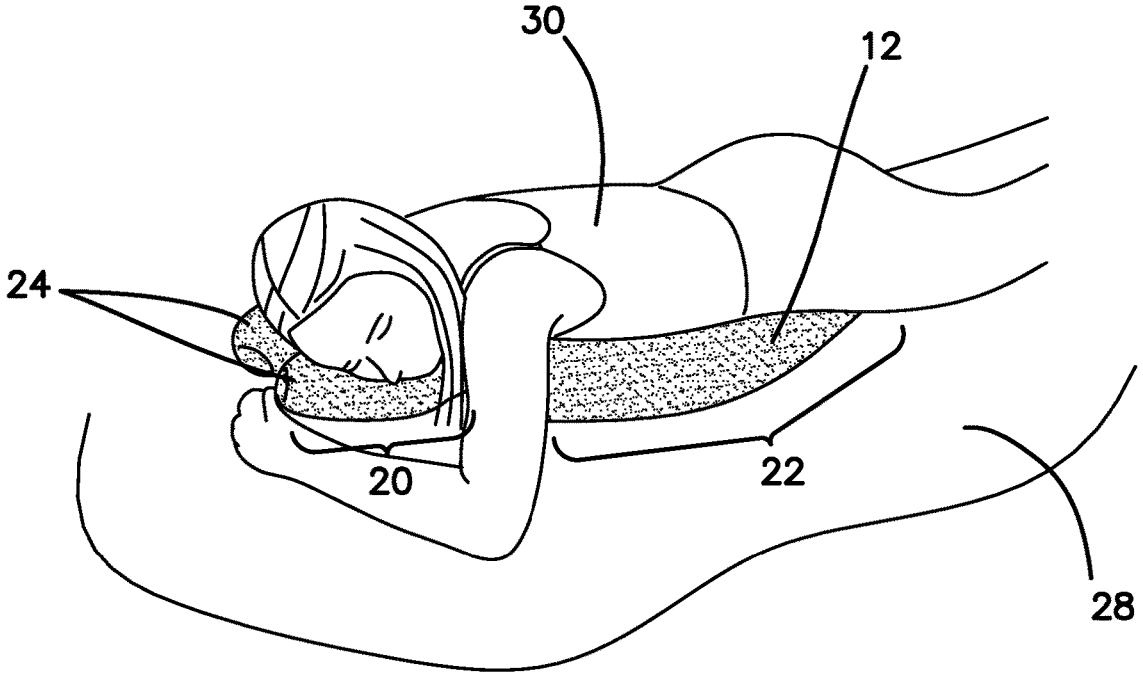
FIG. 11 is a perspective view of the apparatus seen in FIG. 10 after the user has disposed the upper half of their body on the lower portions of each segment, specifically with their head and neck maintained in an elevated position by the lower portions of each segment.
Figure 12:
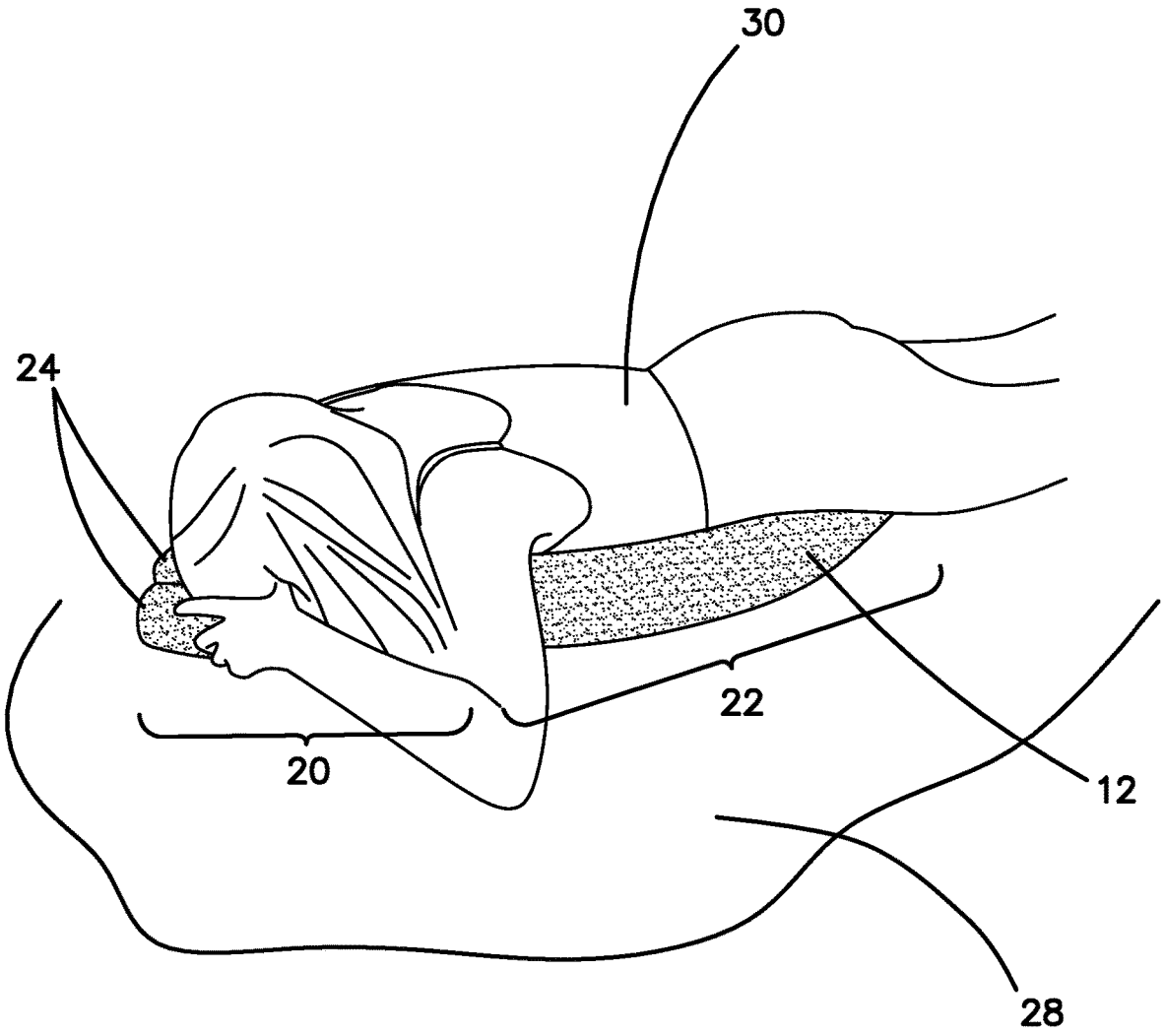
FIG. 12 is a perspective view of the apparatus seen in FIG. 11 with the user in the face down position and maintained in an elevated position by the lower portions of each segment.

Next, as seen in FIG. 11, the lower portion 20 of each segment 24 is manipulated by the user or the patient 30 to provide a head rest for the patient 30. Specifically, each lower portion 20 is independently adjusted, bent, or pivoted about the partition 26 to provide support for the patient's head and neck while the patient 30 has either their head turned as seen in FIG. 11, or in the face down position as seen in FIG. 12. Because each lower portion 20 and each small insert 14 disposed therein of each segment 24 are independently adjustable, an empty volume or space may be created between the lower portions 20 of the segments 24, thereby allowing a patient 30 to remain intubated and on a ventilator even while in the prone position. The lower portion 20 of each segment 24 can also be bent toward each of the upper portions 22 for even more under-armpit support which then allows the patient 30 to use their normal head pillow if desired. In a related embodiment, the distal ends of each segment 24 further comprises corresponding snap buttons, segments of hook and loop fabric, straps, magnets, or other means for coupling to one another so that a substantially donut or ring shaped head rest may be formed for the patient 30 by joining the distal ends of the lower portions 20 of the segments 24 together.

When the support 10 is no longer needed, the large inserts 16 are removed from the body 12 by pulling each large insert 16 proximally out of the opening 18. The partition 26 between the lower portions 20 and the upper portions 22 is removed by removing the tightening or clamping means disposed thereon, or by simply untwisting the partition 26. The small inserts 14 are then pulled or moved proximally through each respective segment 24 and then removed from the body 12 through the opening 18. The small and large inserts 14, 16 may then be washed, stored, or used for other purposes, while the body 12 may also be washed and/or folded into a compact configuration and stored. The support 10 may be used again for another patient by reinserting at least some of the plurality of inserts 14, 16 as discussed above and once again placed on a flat surface.

Figure 13:
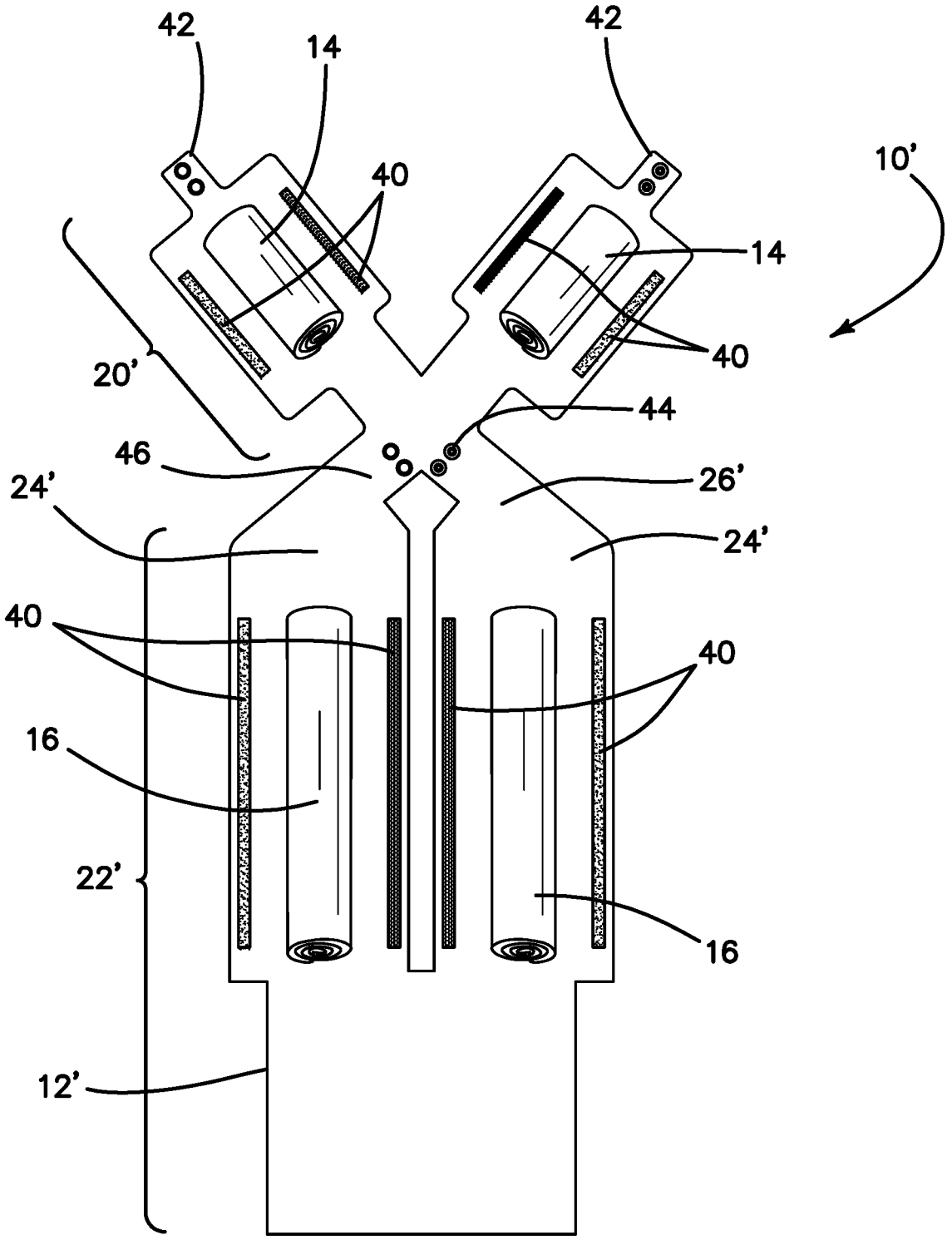
FIG. 13 is top down view of an alternative embodiment of the apparatus, the alternative embodiment comprising the ability to accommodate a plurality of inserts by enveloping each insert at a respective location and then sealing the insert therein via a coupling means such as hook and loop fabric.

In another embodiment seen in FIG. 13, the body 12' of the support 10' comprises one or more slits or openings disposed along the length of each lower portion 20' and each upper portion 22' of each segment 24' so that the body 12' may be completely or substantially undone and laid out flat so as to expose the interior of the body 12'. The edge of the slit corresponds to the upper portions 22' and the lower portions 20' and comprises a plurality of snap buttons, a zipper, or corresponding segments of hook and latch fabric 40 for opening and closing the slit, thereby allowing the user to easily and quickly place or remove the plurality of inserts 14, 16 to and from the body 12'. For example, instead of stuffing each insert 14, 16 through the opening 18 and then pushing the insert 14, 16 through the length of the segment 24, the user may simply open the body 12' by undoing the slit and then inserting one or more of the plurality of inserts 14, 16 into the corresponding lower and upper portions 20', 22' as seen in FIG. 13. The body 12' may be closed by engaging the corresponding segments of hook and latch fabric 40 disposed on each respective longitudinal edge of the lower portions 20' and upper portions 22' and thereby encasing or enclosing the inserts 14, 16 within the body 12' at the desired positions. Additionally, the distal end of each of the lower portions 20' comprises a coupling means 42 such as a patch of hook and loop fabric, snap or friction fit buttons, ties, or other means for joining the lower portions 20' together so as to form a head rest for the patient 30 as detailed above.

In a related embodiment, the partition 26' may be a permanent feature of the body 12' of the support 10'. For example, the partition 26' may comprise a strap, a snap, or a fastener 44 which allows the user to form or create the partition 26' without first having to rotate or twist the lower portions 20 relative to the upper portions 22 of the body 12. Additionally, the body 12' may comprise segments 24' which each comprise a tapered width or substantial funnel shape or portion 46 that are integrally formed together so as to form a natural partition 26' between the lower portions 20' and the upper portions 22'. The combination of an integral partition 26' with dedicated fasteners 44 allows the patient 30 or health care worker to quickly and easily divide the lower portions 20' from the upper portions 22' and thus provide proper upper and lower body support, respectively. The body 12' is further comprised of a material or cloth which is washable and reusable, thereby allowing multiple patients 30 to use the support 10'.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. An apparatus for maintaining a patient in a prone position while maintaining access to an oral airway of the patient, the apparatus comprising:

a body portion;

a pair of lower inserts;

a pair of upper inserts; and means for forming a partition along a length of the body portion, wherein each of the lower inserts and the upper inserts are configured to moved independently of one another within the body portion to provide access to the oral airway of the patient.

2. The apparatus of claim 1 wherein the body portion comprises at least two segments, wherein each of the at least two segments are configured to accommodate at least one of the lower inserts and at least one of the upper inserts therein.

3. The apparatus of claim 2 wherein the means for forming the partition along a length of the body portion comprises means for dividing each of the at least two segments into an upper portion and a lower portion.

4. The apparatus of claim 3 wherein the at least one lower inserts and the at least one upper insert within each of the at least two segments are disposed within the lower portion and within the upper portion of each of the at least two segments, respectively.

5. The apparatus of claim 3 wherein the upper portion of each of the at least two segments are configured to be independently adjustable relative to each other, and wherein the lower portion of each of the at least two segments are configured to be independently adjustable relative to each other.

6. The apparatus of claim 2 wherein the body portion comprises a common opening communicated to each of the at least two segments of the body portion.

7. The apparatus of claim 2 wherein each of the at least two segments comprise a coupling means disposed along at least a portion of their respective longitudinal lengths.

8. The apparatus of claim 2 wherein the means for forming a partition along a length of the body portion comprises at least one tapered width portion disposed along the respective lengths for each of the at least two segments of the body portion.

9. The apparatus of claim 2 wherein the means for forming a partition along a length of the body portion comprises means for coupling the at least two segments of the body portion together.

10. The apparatus of claim 2 wherein the means for forming a partition along a length of the body portion comprises a knot joining the at least two segments to each other.

11. The apparatus of claim 2 wherein each of the at least two segments of the body portion comprise a distal end, each distal end comprising means for coupling the at least two segments together.

12. The apparatus of claim 1 further comprising means for adjusting the relative position of the partition along the length of the body portion.

13. A method for maintaining a patient in a prone position while maintaining access to an oral airway of the patient, the method comprising:

providing a body portion;

inserting a pair of lower inserts into the body portion;

forming a partition along a length of the body portion;

inserting a pair of upper inserts into the body portion; and providing access to the oral airway of the patient by independently adjusting a position associated with each of the pair of lower inserts and each of the pair of upper inserts within the body portion.

14. The method of claim 13 wherein inserting the pair of lower inserts into the body portion comprises inserting at least one of the pair of lower inserts into each of at least two segments defining the body portion, and wherein inserting the pair of upper inserts into the body portion comprises inserting at least one of the pair of upper inserts into each of the at least two segments.

15. The method of claim 14 wherein forming the partition along a length of the body portion further comprises dividing each of the at least two segments into an upper portion and a lower portion.

16. The method of claim 15 wherein adjusting the position associated with each of the pair of lower inserts relative to the pair of upper inserts within the body portion comprises:

adjusting a relative position associated with the upper portion of each of the at least two segments to support the chest and hips of the patient; or adjusting a relative position associated with the lower portion of each of the at least two segments to support the head and neck of the patient.

17. The method of claim 14 wherein forming the partition along a length of the body portion further comprises coupling the at least two segments defining the body portion to each other.

18. The method of claim 14 further comprising coupling a distal end of each of the at least two segments defining the body portion to each other.

19. The method of claim 13 wherein inserting the pair of lower inserts into the body portion comprises disposing at least one of the pair of lower inserts into an upper portion of the body and then sealing the upper portion around the at least one of the pair of lower inserts, and wherein inserting the pair of upper inserts into the body portion comprises disposing at least one of the pair of upper inserts into a lower portion of the body and then sealing the lower portion around the at least one of the pair of upper inserts.

20. The method of claim 19 wherein sealing the upper portion around the at least one of the pair of lower inserts comprises coupling a pair of lateral edges of the upper portion to each other with the at least one of the pair of lower inserts disposed therein, and wherein sealing the lower portion around the at least one of the pair of upper inserts comprises coupling a pair of lateral edges of the lower portion to each other with the at least one of the pair of upper inserts disposed therein.

* * * * *